US005802944A

United States Patent [19]

Bianchi et al.

[11] Patent Number: 5,802,944

[45] Date of Patent: Sep. 8, 1998

[54] GAS CYLINDER WITH INTERNAL TIME DELAY

[75] Inventors: Sabatino A. Bianchi, Bloomfield Hills; Boice F. Horde, Westland; Bernard J. Wallis, Dearborn, all of Mich.

[73] Assignee: Livernois Research and Development Company, Dearborn, Mich.

[21] Appl. No.: 837,300

[22] Filed: Apr. 11, 1997

[51] Int. Cl.[6] ..... B26D 7/28

[52] U.S. Cl. ..... 83/639.1; 83/639.5; 83/128; 83/137

[58] Field of Search ..... 83/128, 123, 137, 83/639.1, 639.5, 208, 255; 91/35, 393; 72/344, 427, 453.07, 453.12, 453.13

[56] References Cited

U.S. PATENT DOCUMENTS

| | | | |
|---|---|---|---|
| 27,801 | 4/1860 | Higginbotham . | |
| 996,692 | 7/1911 | Webb . | |
| 1,763,474 | 6/1930 | Mattern, Jr. . | |
| 1,988,066 | 1/1935 | Zavarella . | |
| 2,089,279 | 8/1937 | Loeffler . | |
| 3,229,957 | 1/1966 | Jehn . | |
| 3,347,461 | 10/1967 | Thorburn . | |
| 3,570,343 | 3/1971 | Wolnosky | 83/639.1 |
| 3,759,483 | 9/1973 | Baxter . | |
| 3,845,690 | 11/1974 | Ziegler | 91/35 |
| 3,906,726 | 9/1975 | Jameson . | |
| 3,990,240 | 11/1976 | Harcuba . | |
| 4,030,391 | 6/1977 | Swanson et al. | 83/137 |
| 4,523,444 | 6/1985 | Fuchs, Jr. | 72/262 |
| 4,583,722 | 4/1986 | Wallis . | |
| 4,774,865 | 10/1988 | Wallis . | |
| 4,934,230 | 6/1990 | Wallis | 83/128 |
| 4,951,537 | 8/1990 | Bennett | 83/128 |
| 5,058,385 | 10/1991 | Everett, Jr. . | |
| 5,170,627 | 12/1992 | Wallis . | |
| 5,237,916 | 8/1993 | Malashenko | 72/453.12 |

*Primary Examiner*—Maurina T. Rachuba
*Attorney, Agent, or Firm*—Barnes, Kisselle, Raisch, Choate, Whittemore & Hulbert

[57] ABSTRACT

A gas cylinder with internal time delay which is entirely self contained within the cylinder. A valve pin that controls communication between the two sides of the piston through one or more a one-way valves in the piston. As each piston is moved by a die into the cylinder body, it exposes a portion of reduced cross section on a valve pin and gas flows through a one way valve such that the effective area of the piston is reduced. When the die moves away from the workpiece, a time delay occurs and the piston is delayed until the piston moves upwardly and closes communication between the sides of the piston.

3 Claims, 3 Drawing Sheets

GAS CYLINDER WITH INTERNAL TIME DELAY

This invention relates to control systems for providing a predetermined time delay in a blanking machine system.

BACKGROUND AND SUMMARY OF THE INVENTION

In a typical fine blanking apparatus, it is desired to accurately cut and punch a part. Such apparatus usually comprises an upper die and a lower die, and a punch base associated with the upper die and movable with respect to the lower die. In the forming of parts, in order to insure the desired precision, it has been common to provide a delay in the movement of the punch base upwardly after the part has been cut and punched from the workpiece. Such a time delay has been produced by cam control of the punch bases or by a hydraulic system associated with the punch bases. A typical example of a hydraulic system is shown in U.S. Pat. No. 3,570,343. Such hydraulic systems have a disadvantage in that they require associated hydraulic fluid lines, valves and the like externally of the hydraulic cushion and the press.

In U.S. Pat. No. 4,774,865, a hydraulic control system is provided wherein a cylinder assembly includes a first piston associated with and exposed to an inert gas such as nitrogen in a manifold, and a second piston engaged by the first piston and urged outwardly into engagement with a punch base. A hydraulic circuit is associated with the second piston and controlled by a valve such that, upon downward movement of the first piston, hydraulic fluid may flow freely without inhibiting the movement of the first piston, but upon actuation of the valve hydraulic, fluid locks the first piston and thereby prevents it from moving upwardly until the valve is actuated so that a predetermined time delay is provided.

In U.S. Pat. No. 4,934,230, there is shown a hydraulic control system wherein a hydraulic time delay circuit is associated with said cylinder assemblies such that, upon downward movement of the pistons, hydraulic fluid may flow freely without inhibiting the movement of the pistons, and upon actuation, hydraulic fluid locks the pistons against movement and thereby prevents them from moving upwardly until the circuit is actuated so that a predetermined time delay is provided.

U.S. Pat. No. 5,170,627 shows a gas cylinder control system for use with machine systems such as die stamping systems that includes at least one gaseous fluid cylinder associated with the machine system, a gaseous intensifier control cylinder normally operated in timed relation to the gaseous cylinder, and a passage providing communication between the gaseous cylinder and the gaseous intensifier control cylinder. The gaseous intensifier cylinder operates at substantially higher pressure than the die cylinder. A normally closed control valve is provided in the passage, and is operable to open the passage in time relation to the operation of the machine system in order to apply the higher gaseous pressure of the gaseous intensifier cylinder to the gaseous cylinder and lock the gaseous cylinder and prevent it from moving until the control valve is actuated to close the passage thereby providing a predetermined time delay. The passage extends from the shaft end of the gaseous cylinder to the piston end of the control system.

Among the objectives of the present invention are to provide a gas cylinder with internal time delay which is entirely self contained within the cylinder; which does not require electrical controls for the time delay; and which can be readily adjusted to provide different time delays.

In accordance with the invention, each cylinder is provided with a valve pin that controls communication between the two sides of the piston through one or more a one-way valves in the piston. As each piston is moved by the die inwardly of the cylinder body, it exposes a portion of reduced cross section on the valve pin such that gas flows through the one way valve and the effective area of the piston is reduced. When the die moves away from the workpiece, a time delay occurs and the piston is delayed until the piston moves and closes communication between the sides of the piston.

DESCRIPTION OF THE PREFERRED EMBODIMENT

Figure 1:
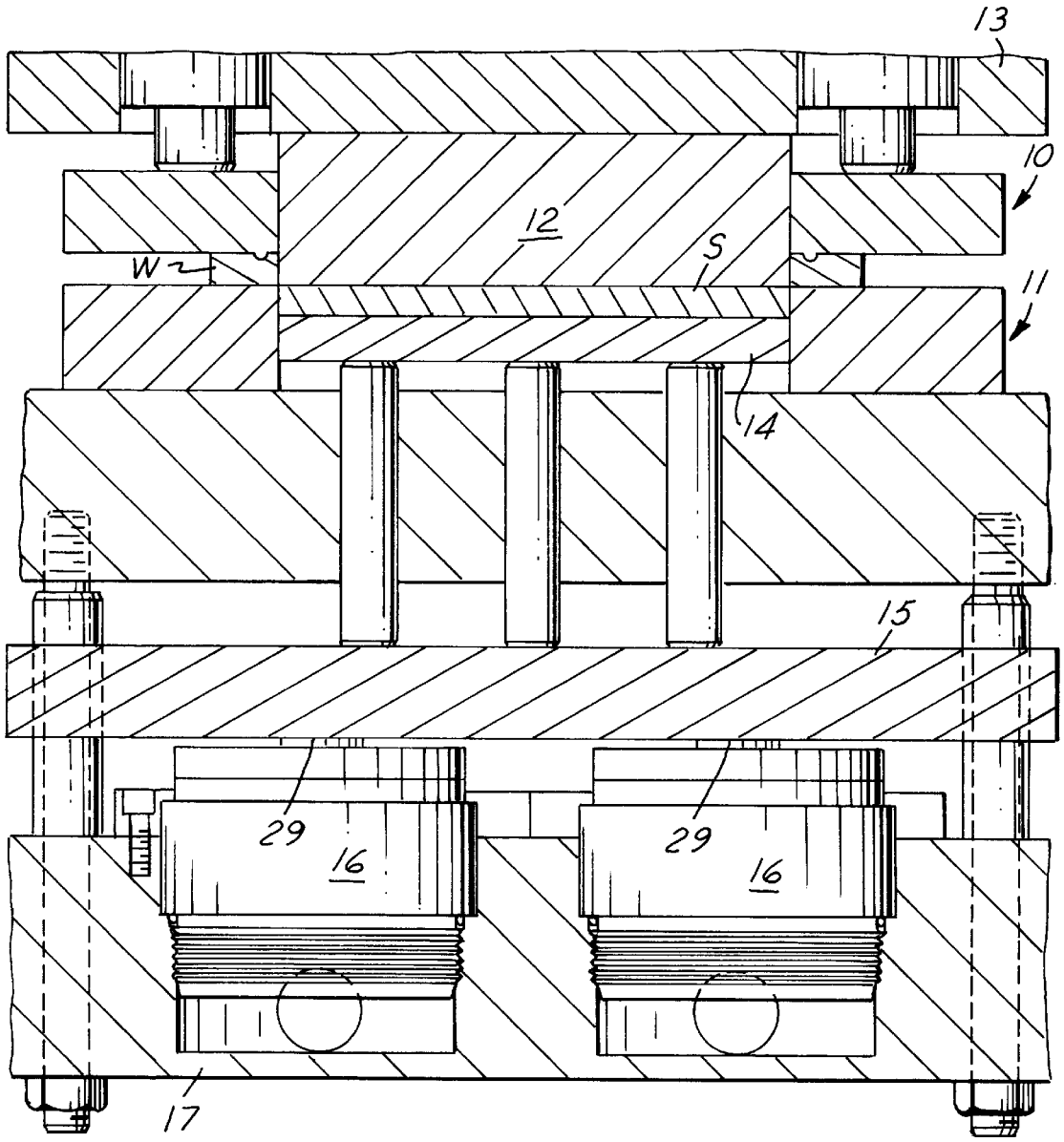
FIG. 1 is a vertical sectional view of a die system utilizing the invention.
Figure 2:
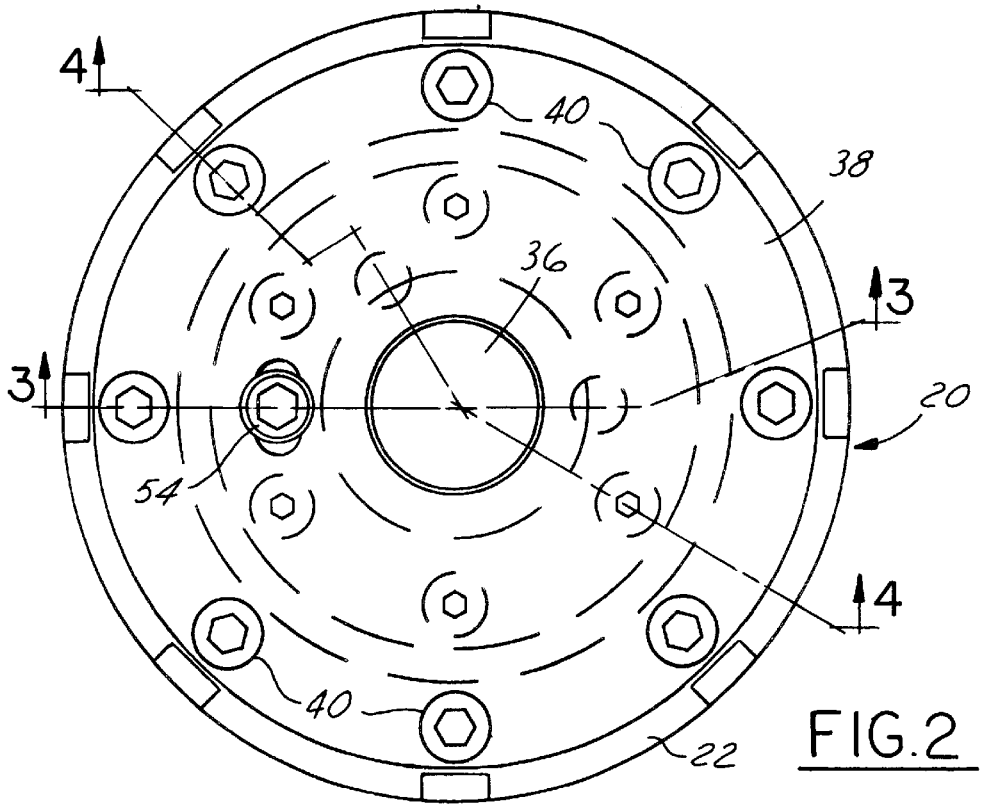
FIG. 2 is a top plan view of a gas cylinder with internal time delay embodying the invention.

Referring to FIG. 1, the die stamping system for fine blanking and embodying the invention is intended to be used with a die stamping apparatus in a press wherein an upper die assembly 10 is provided on the upper portion of the press and a lower die assembly 11 is provided on the lower portion of the press. The upper die 10 includes an upper punch 12 that is movable by a ram 13 downwardly as viewed in FIG. 1 to punch a slug S from a workpiece W. The lower die 11 includes a lower pad 14 associated with the punch 12 and movable downwardly within the die. A pressure plate 15 is supported by a plurality of cylinder assemblies 16 as presently described. The cylinder assemblies 16 are mounted on a manifold 17 which is supplied with inert gas such as nitrogen under a predetermined high pressure. The pressure of the inert gas may vary between about 500 and 2000 psi.

In accordance with the invention, at least one cylinder assembly 16 is provided with an internal hydraulic time delay means such that the upward movement of the pressure plate 15 is delayed when the die is opened thereby insuring that the ejection of the slug S will not interfere with the precise accurate hole that has been cut into the workpiece W.

Referring to FIGS. 2–6, each delay cylinder assembly 16 includes a cylinder body 20 having a cylindrical side wall 22 and an integral top wall 24. The lower end of the side wall 22 includes a shoulder 26 defining a thinner wall portion 28 that is provided with a thread as at 30 for engagement with the manifold 17.

Figure 3:
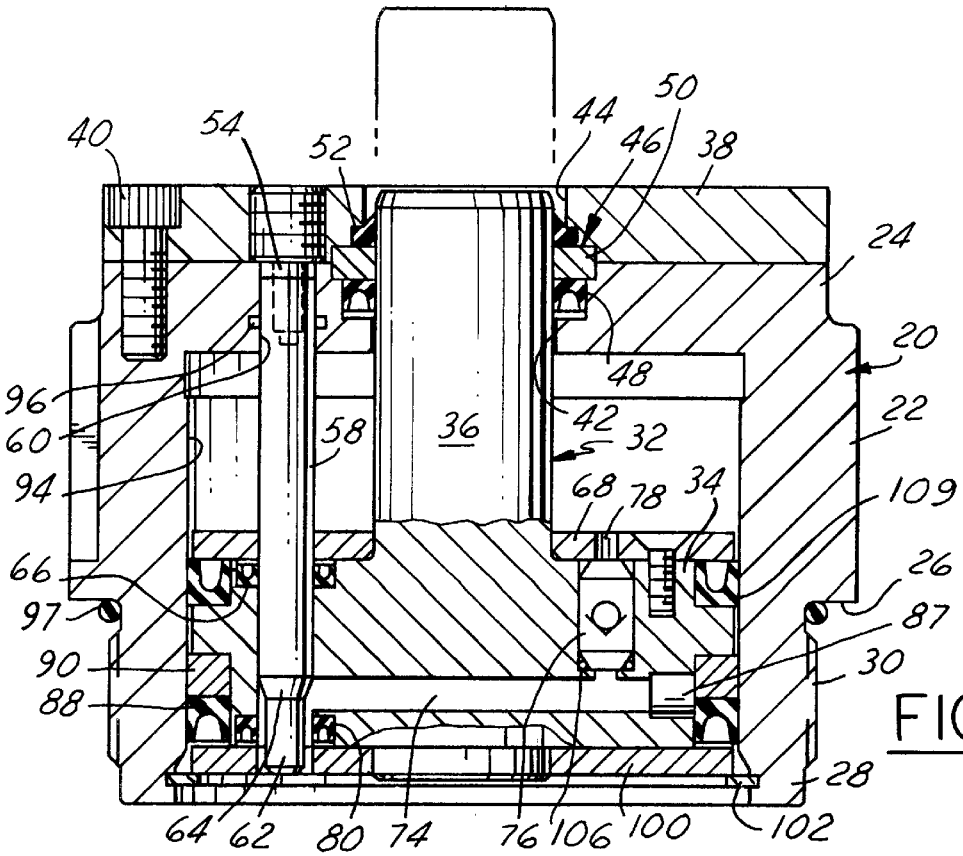
FIG. 3 is a sectional view taken along the line 3—3 in FIG. 2.
Figure 4:
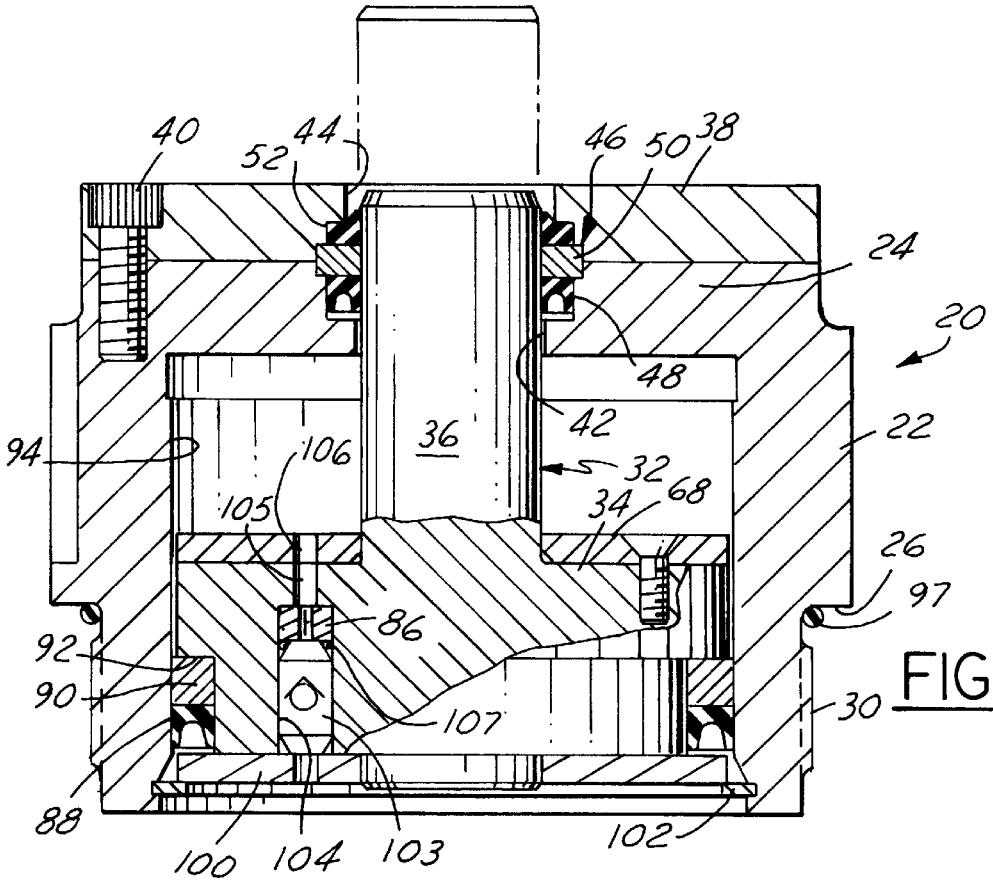
FIG. 4 is a sectional view taken along the line 4—4 in FIG. 2.
Figure 6:
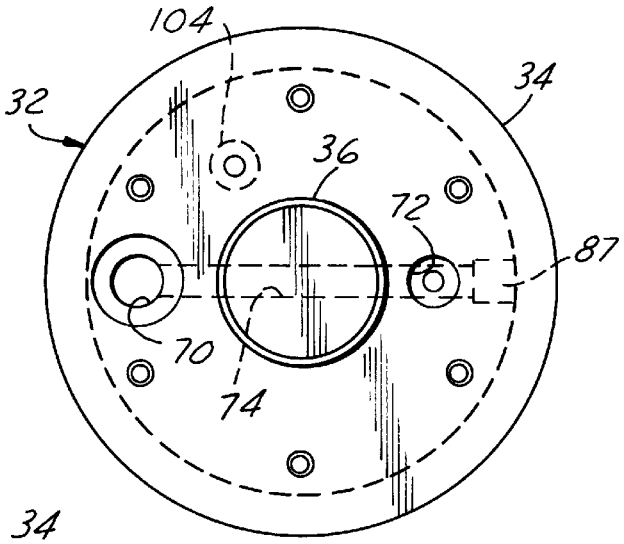
FIG. 6 is a top plan view of the gas cylinder piston embodying the invention.

Referring to FIGS. 3 and 4, a piston assembly 32 is provided within the cylindrical body 20 and includes a piston 34 and a rod 36. A retainer cap 38 is provided on the base wall 24 and is retained in position by screws 40. The rod 36 projects through openings 42, 44 in the base wall 24 and cap 38. A seal assembly 46 is provided about the rod 36 and includes a lower cup seal 48, a bearing 50 and a wiper 52 seated in annular opposed grooves in the base wall 24 and cap 38.

A valve pin 54 extends into the cylinder body 20 through an opening 60 (FIG. 3). The valve pin 54 includes an intermediate portion 58. The lower end 62 of the valve pin 54 has a reduced cross section connected by a tapered portion 64 to the intermediate portion 58. A cup seal 66 is provided in the piston 34 for sealing against the valve pin 54 and is retained in position by a seal retainer plate 68 held in position by screws.

Figure 5:
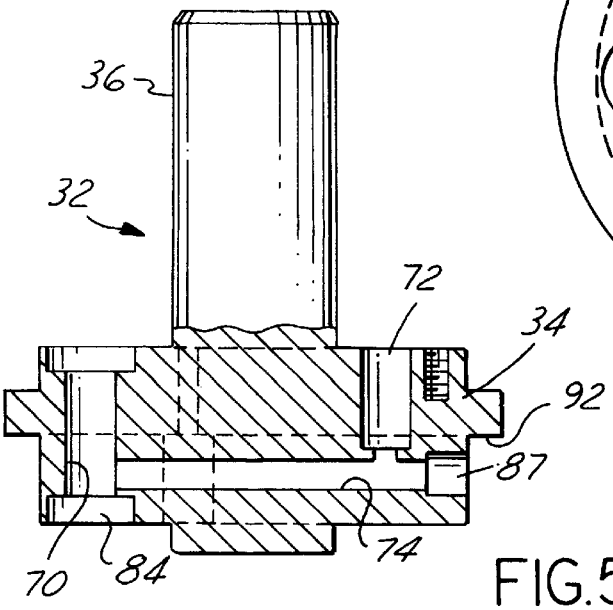
FIG. 5 is a part sectional elevational view showing the piston used in the gas cylinder embodying the invention.

As shown in FIG. 5, piston 34 includes a cylindrical axial opening 70 through which the valve pin 54 extends, and a cylindrical opening 72 spaced from opening 70 and connected thereto by a transverse passage 74 to the periphery of the piston 34. A first one-way valve 76 (FIG. 3) is positioned in the cylindrical opening 72, and is retained by the seal retainer plate 68 which has an opening 78 communicating with the upper portion of the piston 34.

A second one-way valve 103 (FIG. 4) and orifice plug 86 are provided in a second axial opening 104 in piston 38 and is retained by plate 68 and a plate 100. An O-ring 107 is provided between plug 108 and valve 103. A plug 87 (FIG. 3) closes the end of the passage 74. A cup seal 88 and bearing 90 are provided along the shoulder 92 of the lower portion of the piston 34 for engagement with the internal cylindrical surface 94 of the cylinder body 20. An O-ring 96 is provided at the upper end of the intermediate portion 58 and functions as a seal, and an O-ring 97 is provided at the shoulder 26 of the cylinder body for sealing against the manifold. The lower sealing plate 100 is held in position on the lower end of the body portion 28 by a snap ring 102.

One or more of die cylinders 16 are placed in the manifold 17 as shown in FIG. 1. In operation, the die cylinders 16 operate as follows:

1. At the beginning of the cycle, the piston 32 of each cylinder 16 is held in the outward position as shown in broken lines in FIG. 3 under the pressure of the gas such as nitrogen in the manifold.
2. Upon lowering of the press, the piston 32 moves downwardly until at the end of the stroke, seal 64 (FIG. 3) leaves the intermediate portion 58 of the valve pin 54 and nitrogen pressure is applied through passage 74 to the first one-way valve 76 and, in turn, to the upper end of the piston 32. As a result, the net pressure on the piston is reduced at the area of the rod 32.
3. When the die is elevated, a delay in return of the piston 32 will occur due to the orifice in orifice plug 86 and second one-way valve 103.
4. As the piston 32 moves outwardly, the seal 66 will engage the intermediate portion 58 of valve pin 54, closing communication with passage 74 and full pressure of the manifold is applied to the piston 32.

It can thus be seen that there has been provided a gas cylinder with internal time delay which is entirely self contained within the cylinder; which does not require electrical controls for the time delay; and which can be readily adjusted to provide different time delays.

We claim:

1. In a die stamping system in which an upper die moves downwardly toward and upward away from a lower die to stamp a workpiece, and in which a portion of the lower die is supported by at least one gas cylinder coupled to gas under pressure to cushion downward motion of the lower die portion and delay upward motion of the lower die portion, the improvement wherein said at least one gas cylinder comprises:

a piston disposed in a cylinder body with a piston rod for engaging said lower die portion, a pair of one-way valve means disposed within and carried by said piston, and passage means in said piston responsive to downward movement of said piston within said cylinder for feeding gas from a lower side of said piston to an upper side of said piston within the cylinder through a first of said one-way valve means, a second of one of said one-way valve means including means for retarding gas flow therethrough from the upper side of said piston to the lower side of said piston so as to delay upward motion of said piston during upward motion of said upper die.

2. The system set forth in claim 1 wherein said passage means comprises a valve pin fixed in said cylinder and extending through an opening in said piston, and a cross passage in said piston coupling said opening to said first valve means, said valve pin having a portion of reduced cross section that opens gas flow through said cross-passage to said first valve means upon downward motion of said piston within said cylinder.

3. The system set forth in claim 1 wherein said second one-way valve means includes an orifice plug for retarding gas flow through said second one-way valve means from said upper side of said piston to said lower side of said piston.

* * * * *